US008631901B2

(12) United States Patent
Honji et al.

(10) Patent No.: US 8,631,901 B2
(45) Date of Patent: Jan. 21, 2014

(54) ACOUSTIC STRUCTURE

(75) Inventors: Yoshikazu Honji, Hamamatsu (JP); Junichi Fujimori, Hamamatsu (JP); Makoto Kurihara, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/106,648

(22) Filed: May 12, 2011

(65) Prior Publication Data

US 2011/0278091 A1 Nov. 17, 2011

(30) Foreign Application Priority Data

May 17, 2010 (JP) ..... 2010-113690
Dec. 15, 2010 (JP) ..... 2010-279660

(51) Int. Cl.
*E04B 1/82* (2006.01)
*E04B 1/84* (2006.01)

(52) U.S. Cl.
USPC ..... 181/293; 181/295

(58) Field of Classification Search
USPC ..... 181/210, 290, 293, 295, 286, 292; 52/144, 145
See application file for complete search history.

(56) References Cited

U.S. PATENT DOCUMENTS 2,350,513 A * 6/1944 Leadbetter ..... 52/145
2,887,173 A * 5/1959 Boschi ..... 181/286
2,989,136 A * 6/1961 Wohlberg ..... 181/224
4,821,841 A * 4/1989 Woodward et al. ..... 181/286
4,989,688 A * 2/1991 Nelson ..... 181/287
6,021,612 A 2/2000 Dunn et al.
6,892,856 B2 5/2005 Takahashi et al.
2002/0017426 A1 2/2002 Takahashi et al.
2005/0167193 A1 * 8/2005 Van Reeth ..... 181/293
2006/0059801 A1 3/2006 Allaei
2010/0065369 A1 3/2010 Honji

FOREIGN PATENT DOCUMENTS

CN 101404159 A 4/2009
GB 803835 A 11/1958
JP 2002-30744 A 1/2002
JP 2010-84509 A 4/2010

OTHER PUBLICATIONS

Extended European Search Report dated Dec. 2, 2011 (six (6) pages).
Chinese Office Action dated Jun. 12, 2012, including English translation (eleven (11) pages).
Chinese Office Action with English translation dated Nov. 22, 2012 (sixteen (16) pages).
Chinese Office Action dated Apr. 3, 2013 w/ English Translation (eleven (11) pages).

* cited by examiner

*Primary Examiner* — Jeremy Luks
(74) *Attorney, Agent, or Firm* — Crowell & Moring LLP

(57) ABSTRACT

An acoustic structure includes plate members defining a plurality of hollow regions in parallel relation to each other. Opening portions are formed in one surface (reflective surface) of the plate members in corresponding relation to the hollow regions and in such a manner as to communicate the hollow regions with an external surface. A plurality of sound absorbing members are provided in a dispersed fashion on regions of the one surface (reflective surface) other than the opening portions and neighborhoods of the opening portions. As a modification, a sound absorbing member may be loaded in one of the hollow regions and partly exposed to the outer space through the corresponding opening portion.

6 Claims, 7 Drawing Sheets

ACOUSTIC STRUCTURE

BACKGROUND

The present invention relates to techniques for preventing acoustic inconveniences in acoustic spaces.

In an acoustic space, such as a hall or theater, surrounded by walls, acoustic inconveniences, such as booming and flatter echoes, may occur by sounds being repeatedly reflected between the walls opposed parallel to each other. FIG. 10 is a front view of a conventionally-known acoustic structure 50 suited to prevent the above-mentioned acoustic inconveniences. The conventionally-known acoustic structure 50 comprises a plurality of rectangular cross-sectional pipes 51-j (j=1-7) of different lengths arranged in parallel relation to one another so as to define a flat surface as a whole. Further, each of the rectangular cross-sectional pipes 51-j (j=1-7) is formed of a reflective material having a high rigidity. Further, the rectangular cross-sectional pipes 51-j (j=1-7) have respective opening portions 52-j (j=1-7) that are oriented (or open) in a same direction. The acoustic structure 50 is installed on an inner wall, ceiling, or the like with the openings 52-j (j=1-7) of the pipes 51-j (j=1-7) oriented toward the middle of an acoustic space.

In the thus-constructed acoustic structure, each of the pipes 51-j (j=1-7) resonates in response to sound waves of a particular resonance frequency of sound waves falling from the acoustic space in the individual opening portions 52-j (j=1-7). Because of such resonance, sound waves radiated from interior hollow regions of the pipes 51-j (j=1-7) to the acoustic space via the opening portions 52-j (j=1-7) produce sound absorbing and sound scattering effects near the opening portions 52-j (j=1-7). As a consequence, sound waves propagated from the acoustic space toward the pipes 51-j (j=1-7) are dissipated in the pipes 51-j (j=1-7), so that occurrence of acoustic inconveniences can be prevented. An example of this type of acoustic structure 50 is disclosed in Japanese Patent Application Laid-open Publication No. 2002-30744 (patent literature 1).

In the aforementioned type of acoustic structure 50, the sound absorbing and sound scattering effects are produced at resonant frequencies determined by respective constructions of the pipes 51-j (j=1-7). Each of the pipes 51-j (j=1-7) has not only a fundamental resonance mode but also a high-order resonance mode. Thus, the acoustic structure 50 can achieve sound absorbing and sound scattering effects over wide frequency bands by causing each of the pipes 51-j (j=1-7) to resonate not only in the fundamental resonance mode but also in the high-order resonance mode.

Actually, however, with the pipes 51-j of the acoustic structure 50, sound absorbing and sound scattering effects produced in response to sound waves of high frequency bands, particularly in a range of 2 kHz-4 kHz, entering or falling in the opening portions 52-j are smaller than sound absorbing and sound scattering effects produced in response to sound waves of low frequency bands falling in the opening portions 52-j (j=1-7). Thus, when sound waves of high frequency bands have been produced in the acoustic space, acoustic energy of the produced sound waves cannot be dissipated sufficiently with the pipes 51-j.

SUMMARY OF THE INVENTION

In view of the foregoing, it is an object of the present invention to provide an improved acoustic structure, which comprises: plate members defining at least one hollow region, and having at least one opening portion formed in a part of thereof in such a manner as to communicate the at least one hollow region with an external space; and a sound absorbing member disposed on a region of an outer surface of the plate members other than the opening portion and a neighborhood of the opening portion.

Once sound waves of high frequency bands, for which sound absorbing and sound scattering effects are difficult to occur, fall on the acoustic structure of the present invention, acoustic energy of the sound waves is dissipated by the sound absorbing member. Thus, even when sound waves of high frequency bands are being produced in an acoustic space (external space), the acoustic structure of the present invention can reliably prevent acoustic inconveniences from occurring in the acoustic space.

According to another aspect of the present invention, there is provided an acoustic structure, which comprises: plate members defining a plurality of hollow regions, and having a plurality of opening portions formed therein in such a manner as to communicate individual ones of the hollow regions with an external space; and a sound absorbing member loaded in at least one of the plurality of hollow regions, the sound absorbing member being partly exposed to the external space through the opening portion corresponding to the at least one hollow region.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

(A) of FIG. 1 is a left side view of a first embodiment of an acoustic structure of the present invention, (B) of FIG. 1 is a front view of the acoustic structure, and (C) of FIG. 1 is a right side view of the acoustic structure.

Figure 4:
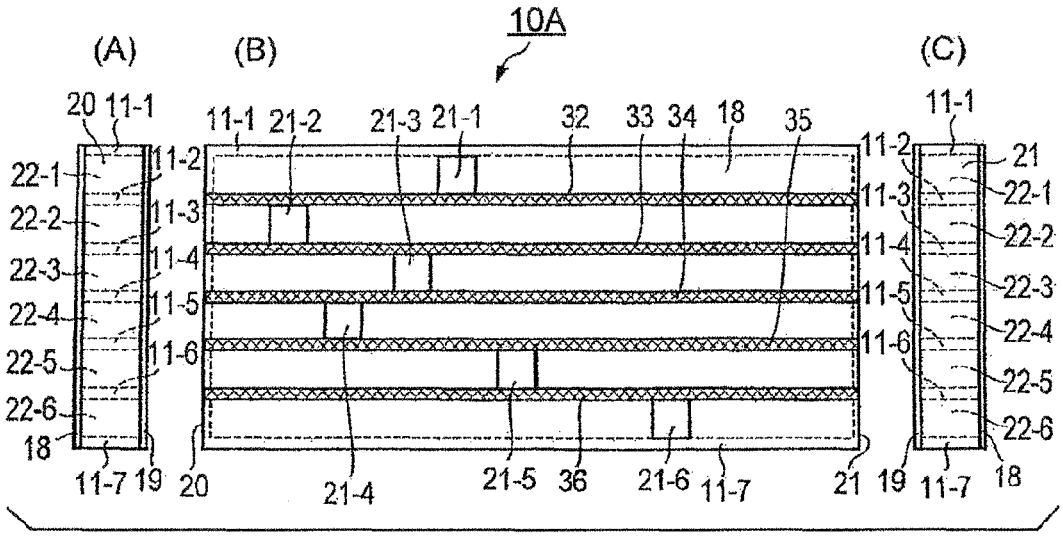
Figure 5:
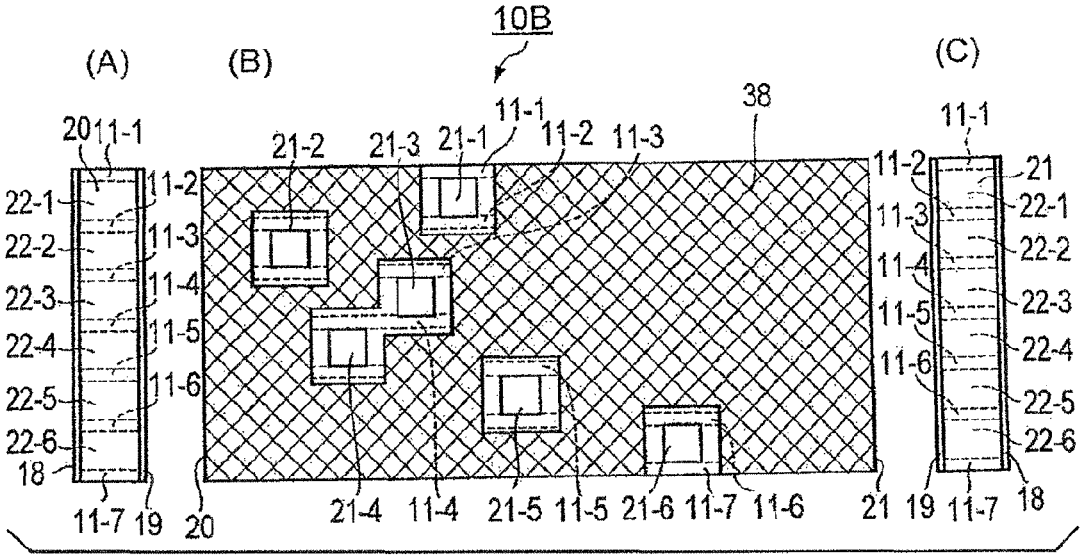
Figure 6A:
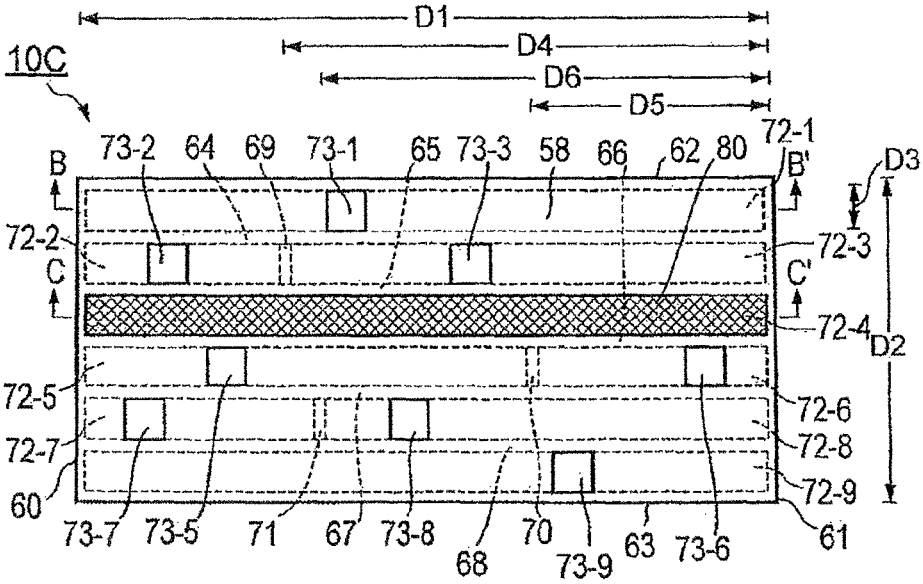
Figure 6B:
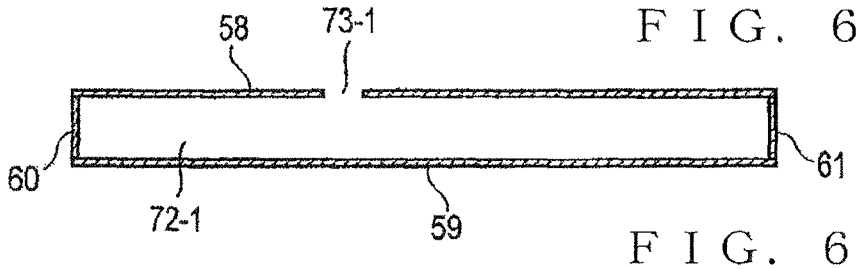
Figure 6C:
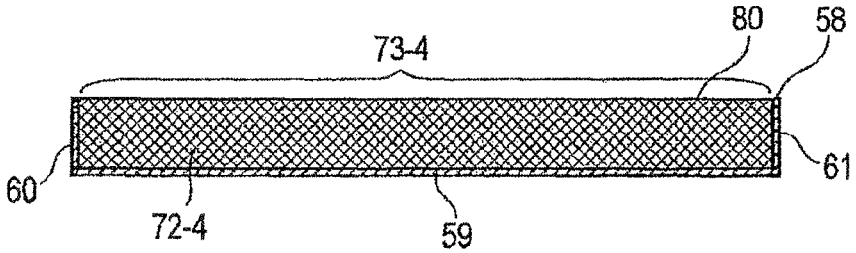
Figure 7A:
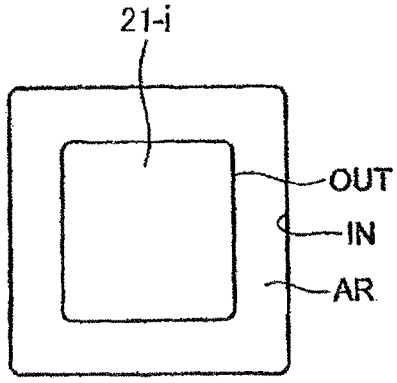
Figure 7B:
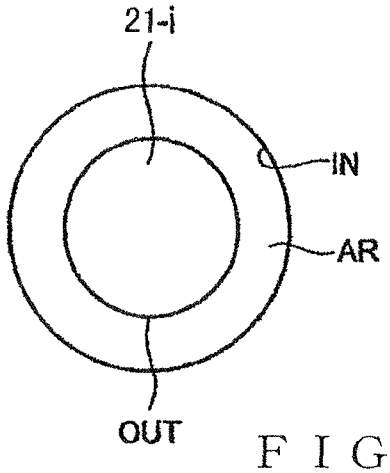
Figure 7C:
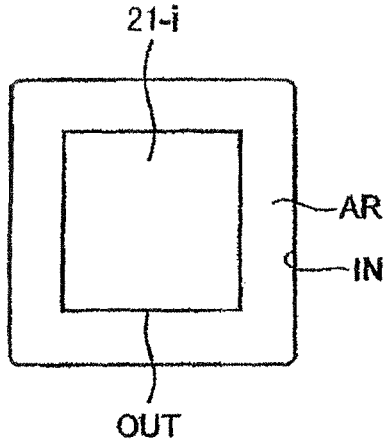
Figure 8:
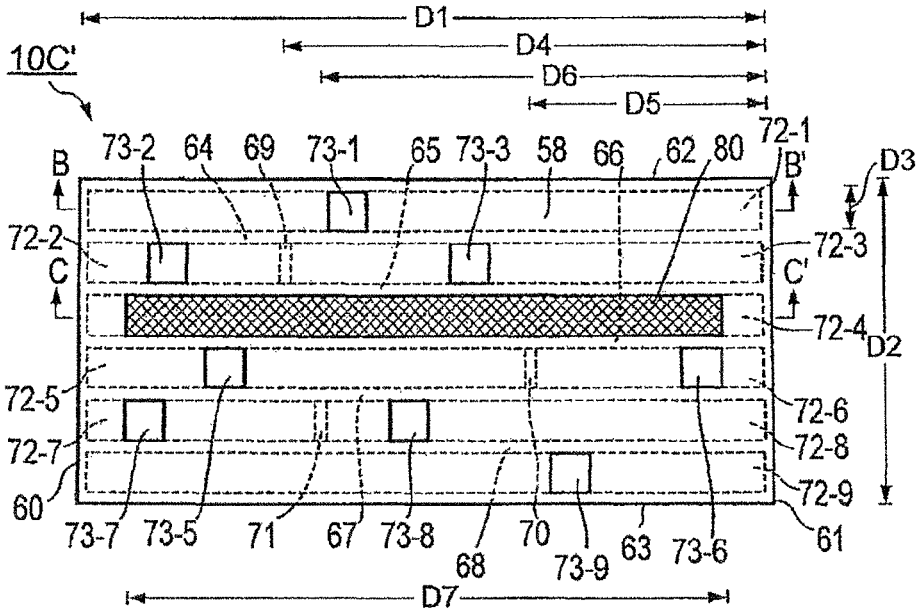
Figure 9A:
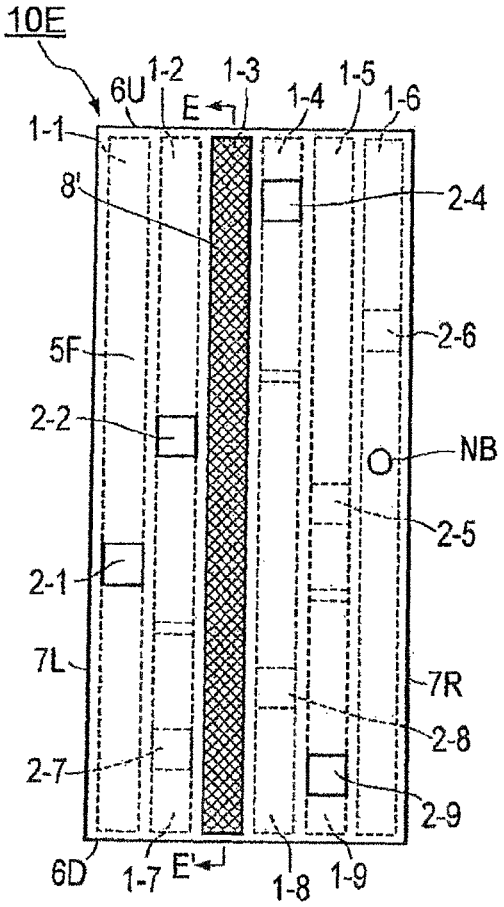
Figure 9B:
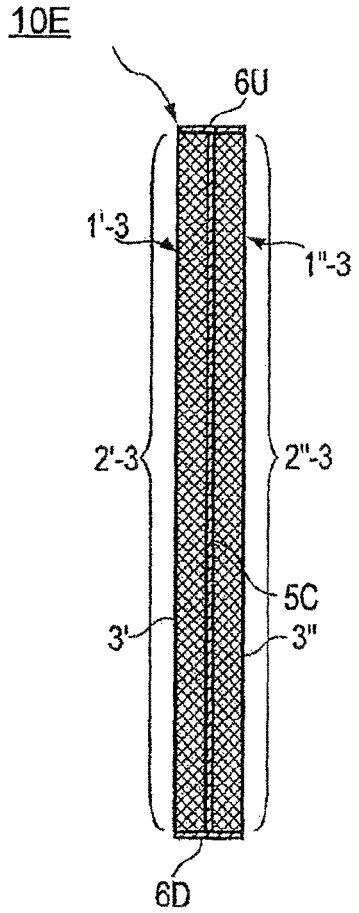
Figure 10:
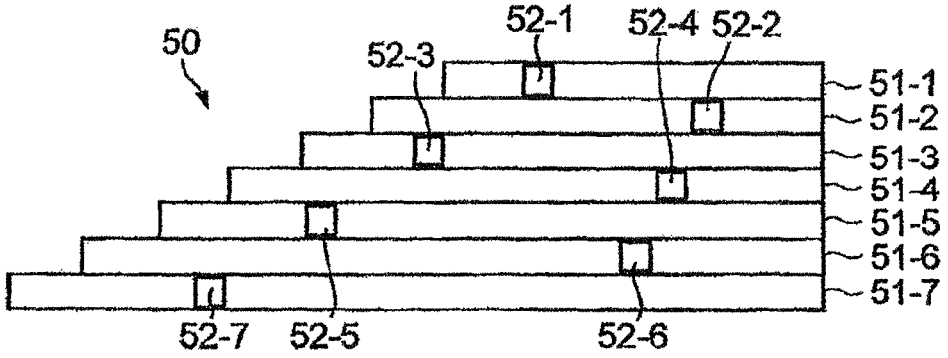
(PRIOR ART) FIG. 10

(A), (B) and (C) of FIG. 4 are a left side view, front view and right side view, respectively, of a second embodiment of the acoustic structure of the present invention;

(A), (B) and (C) of FIG. 5 are a left side view, front view and right side view, respectively, of a third embodiment of the acoustic structure of the present invention;

FIGS. 6A, 6B and 6C are a front view and sectional views of a fourth embodiment of the acoustic structure of the present invention;

FIGS. 7A to 7C are views showing other embodiments of the acoustic structure of the present invention;

FIG. 8 is a front view of still another embodiment of the acoustic structure of the present invention;

FIGS. 9A and 9B are a front view and sectional view, respectively, of a sound-adjusting-panel-function-equipped door constructed as still another embodiment of the acoustic structure of the present invention; and FIG. 10 is a front view showing a conventionally-known acoustic structure.

DETAILED DESCRIPTION

Figure 1:
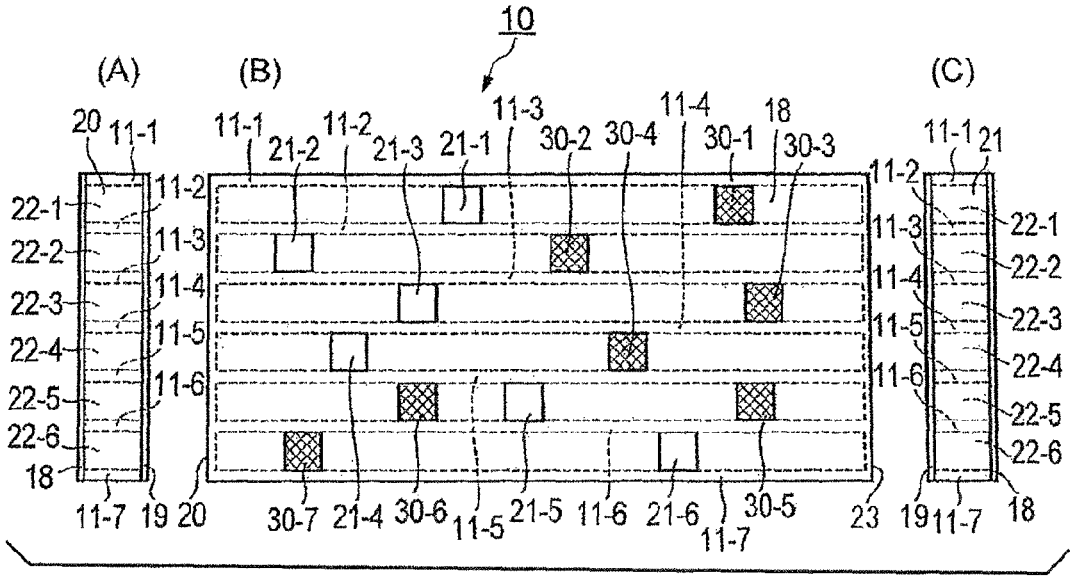

First Embodiment (A) of FIG. 1 is a left side view of a first embodiment of an acoustic structure 10 of the present invention, (B) of FIG. 1 is a front view of the acoustic structure 10, and (C) of FIG. 1 is a right side view of the acoustic structure 10. The acoustic structure 10 includes two plates 18 and 19 provided in spaced-apart opposed relation to each other, and a plurality of plates 11-n (n=1-7), 20 and 23 interposed between the plates 18 and 19. The plates 11-n (n=1-7), 20 and 23 partition the space between the plates 18 and 19 into interior hollow regions 22-i (i=1-6) extending horizontally in a left-right direction, and the plates 20 and 23 close the left and right ends of the interior hollow regions 22-i (i=1-6). Those plates 18, 19, 20, 23 and 11 constitute plate members of the acoustic structure 10.

The plate 18 of the acoustic structure 10 has opening portions 21-i (i=1-6) formed therein. Each of the opening portions 21-i (i=1-6) in the plate 18 functions to communicate the interior hollow region 22-i, surrounded or defined by the plates 18, 19, 11-i, 11-(i+1), 20 and 23, with an acoustic space that is a room space where the acoustic structure 10 is installed. Further, sound absorbing members 30-m (m=1-7) are fixedly attached, e.g. by adhesive, to desired positions of a surface of the plate 18 opposite from the interior hollow regions 22-i (i=1-6), i.e. an outer surface which sound waves fall on (hereinafter referred to as "reflective surface ref"). Functions of the sound absorbing members 30-m will be detailed later.

The acoustic structure 10 is installed on an inner wall or ceiling of the acoustic space with the plate 18, having the opening portions 21-i (i=1-6) formed therein, oriented toward the middle of the acoustic space. The acoustic structure 10 thus installed with plate 18 oriented toward the middle of the acoustic space produces sound absorbing and sound scattering effects, so that it dissipates acoustic energy of sound waves propagated from the acoustic space toward the acoustic structure 10. The following explain basic principles on which the acoustic structure 10 produces the sound absorbing and sound scattering effects.

Figure 2:
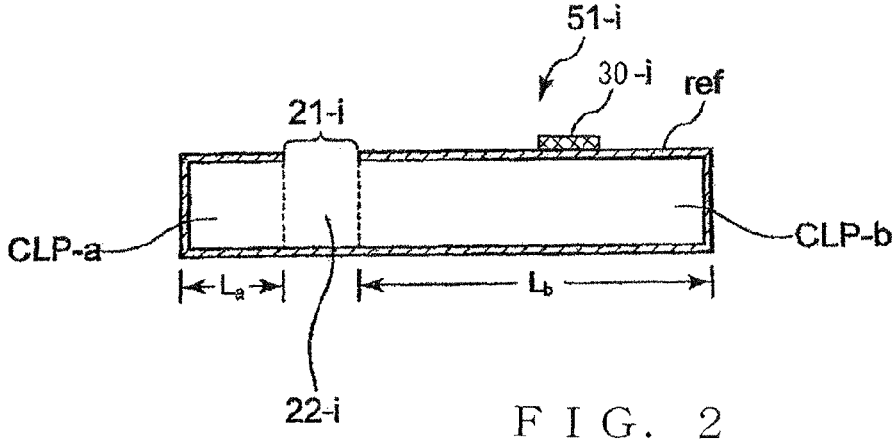
FIG. 2 is a vertical sectional view of the first embodiment of the acoustic structure.

As shown in a sectional view of FIG. 2, it can be regarded that, in the interior hollow region 22-i behind or inside each one of the opening portions 21-i of the acoustic structure 10 are formed an acoustic pipe CLP-a with the opening portion 21-i as an open end and with the left end of the interior hollow region 22-i as a closed end, as well as an acoustic pipe CLP-b with the opening portion 21-i as an open end and with the right end of the interior hollow region 22-i as a closed end. Once sound waves enter the interior hollow region 22-i from the acoustic space via the opening portion 21-i, there occur waves traveling from the open end (opening portion 21-i) to the closed end (left end of the interior hollow region 22-i) of the acoustic tube CLP-a and waves traveling from the open end (opening portion 21-i) to the closed end (right end of the interior hollow region 22-i) of the acoustic tube CLP-b. The former traveling waves are reflected off the closed end of the acoustic tube CLP-a and the resultant reflected waves get back to the opening portion 21-i, while the latter traveling waves are reflected off the closed end of the acoustic tube CLP-b and the resultant reflected waves get back to the opening portion 21-i.

Then, in the acoustic tube CLP-a, resonance occurs at a resonance frequency $fa_n$ (n=1, 2, . . . ) represented by mathematical expression (1) below, and the traveling waves and reflected waves are combined together in the acoustic tube CLP-a into standing waves having a particle velocity node at the closed end of the acoustic tube CLP-a and a particle velocity antinode at the open end of the acoustic tube CLP-a. Further, in the acoustic tube CLP-b, resonance occurs at a resonance frequency $fb_n$ (n=1, 2, . . . ) represented by mathematical expression (2) below, and the traveling waves and reflected waves are combined together in the acoustic tube CLP-b into standing waves having a particle velocity node at the closed end of the acoustic tube CLP-b and a particle velocity antinode at the open end of the acoustic tube CLP-b. In mathematical expression (1) and mathematical expression (2) below, La indicates a length of the acoustic tube CLP-a (i.e., length from the left end of the interior hollow region 22-i to the opening portion 21-i), Lb indicates a length of the acoustic tube CLP-b (i.e., length from the right end of the interior hollow region 22-i to the opening portion 21-i), c represents a propagation velocity of the sound waves, and n represents an integer equal to or greater than 1 (one).

$$fa_n=(2n-1)\cdot(c/(4\cdot La))(n=1,2,\ldots) \quad (1)$$

$$fb_n=(2n-1)\cdot(c/(4\cdot Lb))(n=1,2,\ldots) \quad (2)$$

Now consider a component of the resonance frequency $fa_n$ of sound waves falling from the acoustic space in the opening portion 21-i and on a region of the reflective surface ref (i.e., surface of the plate 18 opposite from the interior hollow region 22-i) near the opening portion 21-i. Sound waves reflected off the closed end of the acoustic tube CLP-a and then radiated through the opening portion 21-i to the acoustic space are opposite in phase to sound waves falling from the acoustic space in the opening portion 21-i. On the other hand, sound waves falling from the acoustic space on a region of the reflective surface ref near the opening portion 21-i are reflected without involving phase rotation.

Figure 3:
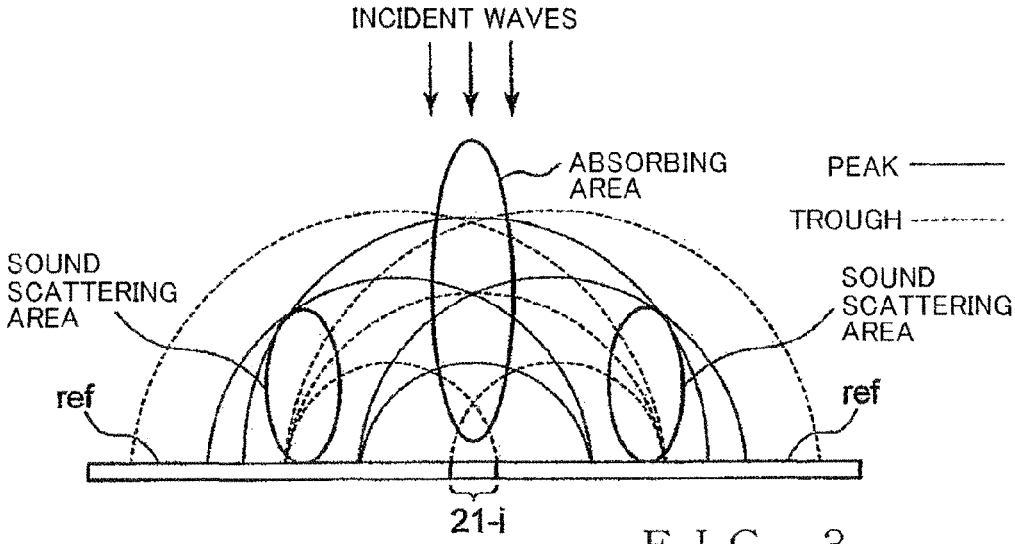
FIG. 3 is a diagram explanatory of principles on which sound absorbing and sound scattering effects are produced by the first embodiment of the acoustic structure.

Thus, as shown in FIG. 3, when sound waves including a component of the resonance frequency $fa_n$ (n=1, 2, . . . ) have entered or fallen in the interior hollow region 22-i through the opening portion 21-i, sound waves radiated from the acoustic tube CLP-a through the opening portion 21-i and sound waves reflected off various points on a region of the reflective surface ref near the opening portion 21-i have phases opposite to each other, so that the phase of the radiated sound waves and the phase of the reflected sound waves interfere with each other and thus there is produced a sound absorbing effect as regards the incident direction as viewed from the opening portion 21-i (i.e., sound absorbing area in FIG. 3). Further, in a sound scattering area where the sound waves from the opening portion 21-i and the reflected sound waves from the reflective surface ref adjoin each other, the sound waves from the opening portion 21-i and the reflected sound waves from the reflective surface ref would become discontinuous in phase. By the sound waves, having such a phase difference, adjoining each other as above, there are produced, in the sound scattering area, flows of gas molecules that would act to eliminate the phase discontinuity are produced in the neighborhood of the sound scattering area. Consequently, in the neighborhood of the sound scattering area, there are produced flows of acoustic energy in other directions than a specular reflection direction corresponding to the incident direction, so that a sound scattering effect is produced. When sound waves including a component of the resonance frequency $fb_n$ (n=1, 2, . . . ) have entered or fallen in the interior hollow region 22-i through the opening portion 21-i, a sound absorbing effect is produced as regards the incident direction where the sound waves are specularly reflected (i.e., the sound absorbing area in FIG. 3). Also, in the neighborhood of the sound scattering area, a sound scattering effect is produced.

Further, in frequency bands near each of the resonance frequencies $fa_n$ and $fb_n$, the phase of the sound waves radiated from the opening portion 21-i to the acoustic space and the phase of the sound waves reflected from the reflective surface ref to the acoustic space will assume near-opposite-phase relationship even when the sound waves are deviated from the resonance frequency $fa_n$ or $fb_n$, as long as the sound waves are close in frequency to resonance frequency $fa_n$ or $fb_n$ to some degree. Thus, in frequency bands near each of the resonance frequencies $fa_n$ and $fb_n$, there are produced sound absorbing and sound scattering effects of degrees corresponding to closeness in frequency to the resonance frequency $fa_n$ or $fb_n$.

The foregoing are details of the basic principles of the sound absorbing and sound scattering effects. As set forth, although such sound absorbing and sound scattering effects are also producible or achievable for sound waves of high frequency bands, the sound absorbing and sound scattering effects producible for sound waves of high frequency bands are smaller (or lower in degree) than those producible for sound waves of low frequency bands. The sound absorbing members 30-m (m=1-7) shown in FIG. 1 serve to compensate for shortages of the sound absorbing and sound scattering effects in high frequency bands. The sound absorbing members 30-m (m=1-7) are in the form of a plurality of small pieces of a material (such as a porous material) of which the absolute value $|\zeta|$ of a specific acoustic impedance ratio to air is equal to or smaller than 1 (one), and are attached to positions of the reflective surface ref which satisfy Condition (a) and Condition (b) below.

Condition (a): Individual positions to which the plurality of sound absorbing members 30-m (m=1-7) are attached should be on regions of the reflective surface ref of the plate 18 other than neighborhoods of the opening portions 21-i (i=1-6). More specifically, the sound absorbing members 30-m (m=1-7) should be attached to positions outside (or surrounding) the respective neighborhoods of the opening portions 21-i (i=1-6) in such a manner that the sound scattering area is produced around each of the opening portions 21-i.

Condition (b): Individual positions to which the plurality of sound absorbing members 30-m (m=1-7) are attached should be dispersed in such a manner that the absorbing members 30-m (m=1-7) are spaced from one another by sufficient distances.

According to the instant embodiment, as set forth above, once sound waves of high frequency bands, for which sound absorbing and sound scattering effects are difficult to occur, fall on the plate 18 having the opening portions 21-i (i=1-6) and reflective surface ref, the incident sound waves are absorbed by the sound absorbing members 30-m (m=1-7) attached to the reflective surface ref. Thus, the instant embodiment can reliably prevent occurrence of acoustic inconveniences, such as booming and flatter echoes, for sound waves of wide frequency bands from low to high frequency bands. As noted above, the sound absorbing members are each formed of a material of which the absolute value $|\zeta|$ of the specific acoustic impedance ratio is equal to or smaller than 1 (one)

Further, in the instant embodiment, the sound absorbing members 30-m (m=1-7) are attached to regions of the reflective surface ref other than the neighborhoods of the opening portions 21-i (i=1-6). Thus, radiation of reflected sound waves having the same phase as incident sound waves from the neighborhoods of the opening portions 21-i (i=1-6) formed in the reflective surface ref can be prevented from being disturbed by the sound absorbing members 30-m (m=1-7). Thus, the instant embodiment can produce generally the same sound absorbing and sound scattering effects as in a case where no such sound absorbing member is attached to the reflective surface ref.

Furthermore, in the instant embodiment, as set forth above, the sound absorbing members 30-m (m=1-7) are in the form of a plurality of small pieces attached to the reflective surface ref in such a manner that the sound absorbing members 30-m (m=1-7) are dispersed to be spaced from one another by sufficient distances. Sound waves reflected off points around the individual sound absorbing members 30-m (m=1-7) on the reflective surface ref fall on the sound absorbing members 30-m (m=1-7) because of diffraction succeeding the reflection, so that they are absorbed by the sound absorbing members 30-m (m=1-7). In this manner, the instant embodiment can enhance a sound absorbing coefficient per unit area as compared to a case where sound absorbing members 30-m (m=1-7) are attached collectively to a single place on the reflective surface ref.

Second Embodiment (A) of FIG. 4 is a left side view of a second embodiment of the acoustic structure 10A of the present invention, (B) of FIG. 4 is a front view of the acoustic structure 10A, and (C) of FIG. 4 is a right side view of the acoustic structure 10A. In (A), (B) and (C) of FIG. 4, similar elements to those in the first embodiment of the acoustic structure 10 (shown in (A), (B) and (C) of FIG. 1) are indicated by the same reference numerals and characters as used for the first embodiment and will not be described here to avoid unnecessary duplication. In the second embodiment of the acoustic structure 10A, belt-shaped sound absorbing members 32, 33, 34, 35 and 36 parallel to the plates 11-2, 11-3, 11-4, 11-5 and 11-6 are fixedly attached to positions on the reflective surface ref of the plate 18 which are opposite to respective one longitudinal side surfaces of the plates 11-2, 11-3, 11-4, 11-5 and 11-6. Namely, a plurality of the sound absorbing members 32 to 36, each having an elongated shape, are disposed with predetermined intervals therebetween in such a manner as to not positionally overlap the opening portions 21-1-21-7. The second embodiment thus arranged too can reliably prevent occurrence, in the acoustic space, of acoustic inconveniences, such as booming and flatter echoes, for sound waves of wide frequency bands from low to high frequency bands.

Third Embodiment (A) of FIG. 5 is a left side view of a third embodiment of the acoustic structure 10B of the present invention, (B) of FIG. 5 is a front view of the acoustic structure 10B, and (C) of FIG. 5 is a right side view of the acoustic structure 10B. In (A), (B) and (C) of FIG. 5, similar elements to those in the first embodiment of the acoustic structure 10 (shown in (A), (B) and (C) of FIG. 1) are indicated by the same reference numerals and characters as used for the first embodiment and will not be described here to avoid unnecessary duplication. In the third embodiment of the acoustic structure 10B, a sound absorbing member 38 is fixedly attached to an entire region of the reflective surface ref of the plate 18 other than the opening portions 21-i (i=1-6) and the respective neighborhoods of the opening portions 21-i (i=1-6). The third embodiment thus arranged too can reliably prevent occurrence, in the acoustic space, of acoustic inconveniences, such as booming and flatter echoes, for sound waves of wide frequency bands from low to high frequency bands.

Fourth Embodiment

FIG. 6A is a front view showing a fourth embodiment of the acoustic structure 10C of the present invention, FIG. 6B is a sectional view taken along the B-B' line of FIG. 6A, and FIG. 6C is a sectional view taken along the C-C' line of FIG. 6A. In the above-described first to third embodiments of the acoustic structure 10, 10A and 10B, one or more sound absorbing members are fixedly attached to the plate 18. By contrast, in the fourth embodiment of the acoustic structure 10C, the interior surrounded by six plates 58, 59, 60, 61, 62 and 63, constituting an outer envelope of the acoustic structure 10C, is comparted into nine interior hollow regions 72-k (k=1-9), and the interior hollow region 72-4 of the nine interior hollow regions 72-k (k=1-9) is loaded with a sound absorbing member 80. The sound absorbing member 80 is partly exposed to the external acoustic space through an opening portion 73-4 corresponding to the hollow region 72-4. More specifically, in the acoustic structure 10C, the plates 60-71 are interposed between the two plates 58 and 59 vertically opposed to each other. Of the plates 60-71, the plates 60 and 61 are spaced from each other in the left-right direction by a distance D1 that is equal to a width or dimension, in the front-rear direction, of the plate 58. The plates 62 and 63 are opposed to each other in a front-rear direction with a distance D2 therebetween that is equal to a width or dimension, in the front-rear direction, of the plate 58. Between the plates 62 and 63 are disposed the plates 64, 65, 66, 67 and 68 in such a manner that every adjoining ones of them are spaced from each other by a distance D3. Further, the plate 69 is disposed between the plates 64 and 65 and at a distance D4 from the plate 61, the plate 70 is disposed between the plates 66 and 67 and at a distance D5 from the plate 61, and the plate 71 is disposed between the plates 67 and 68 and at a distance D6 from the plate 61.

Further, in the acoustic structure 10C, the plate 58 has a plurality of opening portions 73-k (k=1-9), of which the opening portions 73-1, 73-2, 73-3, 73-5, 73-6, 73-7, 73-8 and 73-9 each have a square shape having vertical and horizontal dimensions each equal to the distance D3 between the plates 62 and 64. Further, the opening portion 73-4 has a rectangular shape having a vertical dimension equal to the distance D3 between the plates 62 and 64 and a horizontal dimension equal to the distance D1 between the plates 20 and 21.

The opening portion 73-1 functions to communicate the interior hollow region 72-1, surrounded or defined by the walls 58, 59, 60, 61, 62 and 64, with the external acoustic space, and the opening portion 73-2 functions to communicate the interior hollow region 72-2, surrounded or defined by the walls 58, 59, 60, 64, 65 and 69, with the external acoustic space. Further, the opening portion 73-3 functions to communicate the interior hollow region 72-3, surrounded or defined by the walls 58, 59, 61, 64, 65 and 69, with the external acoustic space, and the opening portion 73-5 functions to communicate the interior hollow region 72-5, surrounded or defined by the walls 58, 59, 60, 66, 67 and 70, with the external acoustic space. Furthermore, the opening portion 73-6 functions to communicate the interior hollow region 72-6, surrounded or defined by the walls 58, 59, 61, 66, 67 and 70, with the external acoustic space, and the opening portion 73-7 functions to communicate the interior hollow region 72-7, surrounded or defined by the walls 58, 59, 60, 67, 68 and 71, with the external acoustic space. Furthermore, the opening portion 73-8 functions to communicate the interior hollow region 72-8, surrounded or defined by the walls 58, 59, 61, 67, 68 and 71, with the external acoustic space, and the opening portion 73-9 functions to communicate the interior hollow region 72-9, surrounded or defined by the walls 58, 59, 60, 61, 63 and68, with the external acoustic space. In addition, the opening portion 73-4 functions to communicate the interior hollow region 72-4, surrounded or defined by the walls 58, 59, 60, 61, 65 and 66, with the external acoustic space. The interior hollow region 72-4 located inwardly of the opening portion 73-4 is loaded with the sound absorbing member 80, and this sound absorbing member 80 has a portion exposed to the external acoustic space through the opening portion 73-4. The portion of the sound absorbing member 80 exposed through the opening portion 73-4 lies in flush with the plate 58 having the opening portion 73-4 formed therein. The foregoing are the details of the construction of the acoustic structure 10C.

In the acoustic structure 10C constructed in the above-described manner, the opening portions 73-1-73-3 and 73-5-73-7, where the sound absorbing member 80 is not provided, each function to form a sound absorbing area similarly to the opening portion 21-i shown in FIG. 3, and by the operation of the sound absorbing member 80 partly exposed through the opening portion 73-4, sound absorbing areas are created around the opening portions 73-1-73-3 and 73-5-73-7. In the case where the opening portion 73-4 is larger in area than the other opening portions 73-1 etc. as shown in FIG. 6C, it is possible to increase the area of the sound absorbing area where the opening portion 73-4 can work for the other opening portions 73-1 etc.

In the instant embodiment of the acoustic structure 10C, no sound absorbing member is attached to the plate 58; instead, the sound absorbing member 80 is loaded in one (i.e., hollow region 72-4) of the nine interior hollow regions 72-k (k=1-9). The sound absorbing member 80 is partly exposed to the external acoustic space through the opening portion 73-4. Thus, this acoustic structure 10C can be formed in a uniform thickness in its entirety and can reliably avoid the problem that occurrence of sound absorbing and sound scattering effects is prevented due to coming-off or detachment, from the plate 58, of the sound absorbing member.

Whereas the foregoing have described some preferred embodiments of the present invention, various other embodiments and modifications are also possible as exemplified below.

(1) In the above-described first to third embodiments of the acoustic structure 10, 10A and 10B, the number of the interior hollow regions 22-i may be seven or more, or five or less, and the interior hollow regions 22-i may differ from one another in horizontal dimension or width.

(2) Further, in the above-described first to third embodiments 10, 10A and 10B, the sound absorbing members 30-m (m=1-7), 31, 32, 33, 34, 35, 36 and 37 may be formed of any other suitable material than a porous material.

(3) Further, in the above-described first to third embodiments, each of the interior hollow regions 22-i may be surrounded or defined by five or less plates, or by seven or more plates.

(4) Further, in the above-described third embodiment (acoustic structure 10B), each of the opening portions 21-i has a square shape, and the region of the reflective surface ref which is located in the neighborhood of each of the opening portions 21-i and in which the absorbing member 38 is not attached (i.e., non-sound-absorbing-member-attached region in the neighborhood of the opening portions 21-i) has a square shape slightly larger than the opening portions 21-i. As a modification, the opening portions 21-i and the non-sound-absorbing-member-attached regions in the neighborhoods of the opening portions may each be of any other desired shape than a square shape, such as a true circular shape or a substantial square shape with four arcuately curved corners. In such a case, the non-sound-absorbing-member-attached regions AR in the neighborhoods of the opening portions 21-i, as shown in FIGS. 7A and 7B, may each be shaped such that the shortest distances from points on the inner periphery IN of the region AR to the outer periphery OUT of the opening portions 21-i are uniform. Alternatively, the outer periphery OUT of the opening portions 21-i and the inner periphery IN of the non-sound-absorbing-member-attached regions AR may be different from each other in shape. For example, as show in FIG. 7C, the outer periphery OUT of the opening portions 21-i may be formed in a square shape and inner periphery IN of the non-sound-absorbing-member-attached regions AR may be formed in a substantial square shape with four arcuately curved corners such that the shortest distances from points on the inner periphery IN of the region AR to the outer periphery OUT of the opening portions 21-i are uniform.

(5) In each of the above-described first to third embodiments of the acoustic structure 10, 10A and 10B, an area $S_o$ of a section, parallel to the plate 18, of at least one (e.g., opening portion 21-1) of the opening portions 21-i (i=1-6) (i.e., area of the opening portion 21-1) may be made smaller than an area $S_p$ of a section, perpendicularly intersecting the plate 18, of the interior hollow region 22-1 (i.e., cross-sectional area $S_p$ of the interior hollow region 22-1). This is because such an acoustic structure 10D where the area $S_o$ is smaller than the area $S_p$ can produce sound absorbing and sound scattering effects over even wider frequency bands.

The reason why the acoustic structure 10D with the area $S_o$ smaller than the area $S_p$ can produce sound absorbing and sound scattering effects over even wider frequency bands is as follows. As set forth above, the sound absorbing effect is an effect produced by the phase of sound waves radiated from the opening portion 21-i to the acoustic space and the phase of sound waves reflected off the reflective surface ref to the acoustic space assume near-opposite-phase relationship when sound waves of the resonance frequencies $fa_n$ and $fb_n$ of the acoustic pipes CLP-a and CLP-b and frequencies near the resonance frequencies $fa_n$ and $fb_n$ have fallen in the acoustic structure 10. Thus, the wider the frequency bands over which sound waves falling in the acoustic structure 10 through the opening portion 21-i and reflected sound waves reflected through the opening portion 21-i toward a direction of incidence of the sound waves assume near-opposite-phase relationship, the wider should become the frequency bands over which the sound absorbing effect can occur.

In this case, an amplitude and phase of sound waves reflected in the direction of incidence from a boundary surface bsur between a first medium (e.g., air within the opening portion 21-i or a rigid material forming the acoustic structure 10) and a second medium (e.g., air within the acoustic structure 10) when sound waves have fallen from the second medium vertically toward the first medium depend on a specific acoustic impedance ratio $\zeta$ ($\zeta=r+jx$:$r=Re(\zeta)$, $x=Im(\zeta)$) of the boundary surface bsur. More specifically, if the absolute value $|\zeta|$ of the specific acoustic impedance ratio of the boundary surface bsur is less than 1 (one), reflected waves having a phase difference within ±180 degrees from the sound waves falling on the boundary surface bsur are radiated from the boundary surface bsur. If $Im(\zeta)>0$, the smaller the absolute value $|Im(\zeta)|$ of an imaginary part Im of the specific acoustic impedance ratio $\zeta$, the closer the phase difference approaches +180 degrees. Further, if $Im(\zeta)<0$, the smaller the absolute value $|Im(\zeta)|$ of the imaginary part Im of the specific acoustic impedance ratio $\zeta$, the closer the phase difference approaches −180 degrees.

If a comparison is made between a frequency characteristic of the imaginary part Im of the specific acoustic impedance ratio $\zeta$ when a ratio rs between the area $S_o$ of the section of the opening portion 21-i and the area $S_p$ of the section of the hollow region 22-i ($rs=S_o/S_p$) is greater than 1 (i.e., $S_o>S_p$) and a frequency characteristic of the imaginary part Im of the specific acoustic impedance ratio $\zeta$ when the ratio rs is smaller than 1 (i.e., $S_o<S_p$), it can be seen that frequency bands over which the imaginary part Im of the frequency characteristic is equal to or smaller than a given value (e.g., $Im(\zeta)=1$) are wider in the former case than in the latter case (see Japanese Patent Application Laid-open Publication No. 2010-84509 (patent literature 2, and particularly FIG. 9 thereof) for details of the relationship between the ratio rs and frequency characteristic of the imaginary part Im). Thus, the smaller than the area $S_p$ the area $S_o$ is, the wider become the frequency bands over which reflected sound waves having a phase difference, nearly the opposite phase, from sound waves entering or falling in the opening portion 21-i can be radiated through the opening portion 21-i. For the foregoing reason, the acoustic structure with the area $S_o$ smaller than the area $S_p$ can produce sound absorbing and sound scattering effects over even wider frequency bands.

(6) In the above-described fourth embodiment of the acoustic structure 10C, the number of the interior hollow regions 72-k may be any one of 2 to 8, and 10 and more. Further, whereas the fourth embodiment has been described above in relation to the case where the interior hollow region 72-4 having the sound absorbing member 80 loaded therein has the same width as the other interior hollow regions 72-1-72-3 and 72-5-72-9, the interior hollow region 72-4 may have a different width from the other interior hollow regions 72-1-72-3 and 72-5-72-9. As another modification, the opening portion 73-4, which functions to communicate the interior hollow region 72-4 with the outside, may have a width D7 in the left-right direction smaller than the width D1, in the left-right direction, of the interior hollow region 72-4. In such a case, the sound absorbing member 80 may be loaded only in a space of the interior hollow region 72-4 immediately under the opening portion 73-4 so that closed spaces are formed to the left and right of the sound absorbing member 80 within the interior hollow region 72-4. As a further modification, the sound absorbing member may be loaded in two or more interior hollow regions 72.

(7) In the above-described fourth embodiment, the sound absorbing member 80 may be formed of any other suitable material than a porous material.

(8) Further, whereas the fourth embodiment has been described above in relation to the case where the interior hollow region 72-4 for loading therein the sound absorbing member 80 has a shape elongated in the left-right direction, the interior hollow region 72-4 may have a shape elongated in the front-rear direction or in an oblique direction, or may be of a combination of such shapes.

(9) As a further embodiment of the present invention, a door may be provided which has, on its one surface or opposite surfaces, the above-described fourth embodiment of the acoustic structure 10C. FIG. 9A is a front view of a door 10E equipped with a sound (or acoustics) adjusting panel function, which has the acoustic structure 10C on its opposite surfaces. FIG. 9B is a sectional view taken along the E-E' line of FIG. 9A. This sound-adjusting-panel-function-equipped door 10E comprises front and back plates 5F and 5B (not shown) provided in overlapping opposed relation to each other with a space therebetween, and plates 6U, 6D, 7L and 7R fixedly joined to the upper and lower and left and right edge surfaces of the front and back plates 5F and 5B. Door knobs NB are provided on the front and back plates 5F and 5B of the door 10E. The interior surrounded by the plates 5F, 5D, 6U, 6D, 7L and 7R is comparted into nine interior hollow regions 1-k (k=1-9). The interior hollow region 1-3 of the nine interior hollow regions 1-k (k=1-9) is comparted, via an interposed plate 5C parallel to the front and back plates 5F and 5B, into interior hollow regions 1'-3 and interior hollow region 1"-3 that are adjacent to the front plate 5F and back plate 5B, respectively. The front plate 5F has opening portions 2-1, 2-2, 2'-3, 2-4 and 2-9 that communicate the interior hollow regions 1-1, 1-2, 1'-3, 1-4 and 1-9 with the outside. The back plate 5B has opening portions 2"-3, 2-5, 2-6, 2-7 and 2-8 that communicate the interior hollow regions 1"-3, 1-5, 1-6, 1-7 and 1-8 with the outside. In the door 10E, a sound absorbing member 3' is loaded in the hollow region 1'-3 and partly exposed to the outside through the opening portion 2'-3, and a sound absorbing member 3" is loaded in the hollow region 1"-3 and partly exposed to the outside through the opening portion 2"-3. With the sound-adjusting-panel-function-equipped door 10E, sound absorbing and sound scattering effects can be produced in each of two acoustic spaces separated from each other via the door 10E interposed therebetween. Furthermore, in this embodiment, the sound absorbing members 3' and 3" and plate 5C may be formed of a transparent or translucent material in such a manner that they permit passage therethrough of light.

The present application is based on, and claims priorities to, JP PA. 2010-113690 filed on May 17, 2010 and JP PA. 2010-279660 filed on Dec. 15, 2010. The disclosure of the priority applications, in its entirety, including the drawings, claims, and the specification thereof, is incorporated herein by reference.

What is claimed is:

1. An acoustic structure comprising:

plate members defining a plurality of hollow regions, and having a plurality of opening portions formed therein in such a manner as to communicate individual ones of the hollow regions with an external space; and a sound absorbing member fully loaded in at least one of said plurality of hollow regions, most of one surface of the sound absorbing member being exposed to the external space through the opening portion corresponding to the at least one hollow region, wherein no sound absorbing member is loaded in at least another one of said plurality of hollow regions, wherein the opening portion corresponding to the at least one hollow region, where the sound absorbing member is loaded, has an area greater than an area of any other of the opening portions that corresponds to the hollow region where the sound absorbing member is not loaded, and wherein the area of the opening portion corresponding to the at least one hollow region, where the sound absorbing member is loaded, is substantially equivalent to an area of the exposed one surface of the sound absorbing member.

2. A door having, on one surface thereof, an acoustic structure recited in claim 1.

3. A door having, on each of opposite surfaces thereof, an acoustic structure recited in claim 1.

4. The door as claimed in claim 3, wherein sound absorbing members of the acoustic structures provided on individual ones of the opposite surfaces of the door are disposed in overlapping opposed relation to each other, and a plate member provided in a region where the two sound absorbing members are separated from each other has a transparent or translucent portion.

5. The acoustic structure as claimed in claim 1, wherein an absolute value of a specific acoustic ratio of a material of the sound absorbing member to air is equal to or smaller than 1.

6. An acoustic structure comprising:

plate members defining a plurality of hollow regions, and having a plurality of opening portions formed therein in such a manner as to communicate individual ones of the hollow regions with an external space; and a sound absorbing member loaded in at least one of said plurality of hollow regions, most of one surface of the sound absorbing member being exposed to the external space through the opening portion corresponding to the at least one hollow region, wherein no sound absorbing member is loaded in at least another one of said plurality of hollow regions, wherein the opening portion corresponding to the at least one hollow region, where the sound absorbing member is loaded, has an area greater than an area of any other of the opening portions that correspond to the hollow region where the sound absorbing member is not loaded, and wherein the area of the opening portion corresponding to the at least one hollow region, where the sound absorbing member is loaded, is substantially equivalent to an area of the exposed one surface of the sound absorbing member.

* * * * *